US009765718B2

(12) United States Patent
Yoo et al.

(10) Patent No.: US 9,765,718 B2
(45) Date of Patent: Sep. 19, 2017

(54) OXYGEN SENSOR HEATER CONTROL SYSTEM AND METHOD THEREOF

(71) Applicant: Hyundai Motor Company, Seoul (KR)

(72) Inventors: Jae Woong Yoo, Gyeonggi-do (KR); Tae Soon Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 2 days.

(21) Appl. No.: 14/950,729

(22) Filed: Nov. 24, 2015

(65) Prior Publication Data

US 2016/0369730 A1 Dec. 22, 2016

(30) Foreign Application Priority Data

Jun. 18, 2015 (KR) ..... 10-2015-0086702

(51) Int. Cl.
*F02D 41/14* (2006.01)
*F02D 41/04* (2006.01)

(52) U.S. Cl.
CPC ..... *F02D 41/1494* (2013.01); *F02D 41/042* (2013.01); *F02D 41/1446* (2013.01)

(58) Field of Classification Search
CPC ..... F02D 41/1446; F02D 41/1447; F02D 41/1494
USPC ..... 123/676, 685, 689, 690, 697
See application file for complete search history.

(56) References Cited

U.S. PATENT DOCUMENTS

2003/0187568 A1* 10/2003 Yasui ..... G05D 23/2401 701/109
2008/0209886 A1* 9/2008 Zillmer ..... B60K 6/48 60/277
2013/0000678 A1* 1/2013 Hocken ..... F02D 41/1466 134/20
2013/0002271 A1* 1/2013 Hocken ..... F02D 41/1466 324/705
2013/0024088 A1* 1/2013 Suzuki ..... F02D 41/1494 701/102
2013/0145815 A1* 6/2013 Nishijima ..... F02D 41/1446 73/1.06
2014/0165979 A1* 6/2014 Nishijima ..... F02D 41/1467 123/672

FOREIGN PATENT DOCUMENTS

JP H 0988688 A 3/1997
JP 2002-256949 A 9/2002
JP 4631664 B2 2/2011
KR 10-0354083 B 9/2002
KR 10-0802951 B 2/2008

* cited by examiner

*Primary Examiner* — Erick Solis
(74) *Attorney, Agent, or Firm* — Brinks Gilson & Lione

(57) ABSTRACT

A method of oxygen sensor heater control includes: exhausting an exhaust gas by operating an internal combustion engine; and stopping operation of the engine such that the exhaust gas is not discharged. The stopping operation of the engine includes heating a sensor element by operating a heater that is positioned adjacent to the sensor element, and the sensor element is configured to detect a characteristic of the exhaust gas.

4 Claims, 6 Drawing Sheets

OXYGEN SENSOR HEATER CONTROL SYSTEM AND METHOD THEREOF

CROSS-REFERENCE TO RELATED APPLICATION

This application claims the benefit of Korean Patent Application No. 10-2015-0086702 filed on Jun. 18, 2015, the entirety of which is hereby incorporated by reference.

FIELD

The present disclosure relates to an oxygen sensor heater control system and method of controlling the same.

BACKGROUND

The statements in this section merely provide background information related to the present disclosure and may not constitute prior art.

In general, an oxygen sensor is mounted at a predetermined position at an exhaust manifold and detects an oxygen amount of the exhaust, and the oxygen sensor provides the oxygen amount information to an engine control unit as feedback information.

Therefore, the engine control unit may determine whether an air/fuel ratio is lean or rich by receiving information from the oxygen sensor, and may control the engine so as to perform combustion with a theoretical air-fuel ratio.

A typical oxygen sensor includes a first oxygen sensor which is installed at a front end of a catalyst device and a second oxygen sensor which is installed at a rear end of the catalyst device, such that the catalyst device is disposed between the first oxygen sensor and the second oxygen sensor.

The first oxygen sensor provides the feedback information about leanness or richness of the air-fuel ratio to the engine control unit. The second sensor senses concentration of oxygen included in the exhaust gas, which is exhausted into the atmosphere after the exhaust gas is purified by the catalyst device, and provides the feedback information to the engine control unit. The first oxygen sensor and the second oxygen sensor may be provided for achieving emission control.

The first oxygen sensor is activated when it is heated by the exhaust gas which is exhausted from the engine and by a heater which is provided thereto. The reason why the oxygen sensor is heated is because a material of a sensing part of the oxygen sensor is activated and operates well when a temperature is over 700° C.

Therefore, if the oxygen sensor is not heated properly, it may not sense and provide information of the leanness or richness of the air-fuel ratio appropriately as a feedback signal. Thus, the engine does not perform combustion at a theoretical air-fuel ratio and it may have an adverse effect on the emission control.

To activate the oxygen sensor when the engine starts, the heater which is disposed in the oxygen sensor is operated. And after the engine starts, as time passes, when the temperature of the exhaust gas is over predetermined temperature, the heater may be controlled by applying a predetermined map value.

Accordingly, overheating of the oxygen sensor is prevented and an appropriate temperature may be maintained.

Meanwhile, the oxygen sensor includes a sensor element, a heater, and a protection tube. The sensor element and the heater are disposed in the protection tube, and the sensor element is placed at a portion where the exhaust gas flows. Therefore, a substance of combustion material of the exhaust gas may adhere to the sensor element, and responsiveness of the sensor element may thereby be delayed or deteriorated.

Particularly, if the temperature in the protection tube is lower than that of the exhaust gas, by an ideal gas equation (PV=nRT), a pressure in the protection tube is relatively lower than at an outer side. Thus, the exhaust gas quickly flows into the protection tube. At this time, if the engine starts, the exhaust gas which has flowed into the protection tube is stabilized, and the combustion material of the exhaust gas may contaminate the sensor element.

SUMMARY

The present disclosure provides an oxygen sensor heater control system and a method thereof capable of improving responsiveness of the sensor element by preventing a foreign substance from adhering to an oxygen sensor.

The method of an oxygen sensor heater control according to an exemplary embodiment of the present invention may include: exhausting an exhaust gas by operating an internal combustion engine; and stopping operation of the engine such that the exhaust gas is not discharged. The stopping operation of the engine may include heating a sensor element by operating a heater that is positioned adjacent to the sensor element, and the sensor element may detect a characteristic of the exhaust gas.

The method of an oxygen sensor heater control may further include controlling the heater such that a temperature of the sensor element is greater than a temperature of the exhaust gas which is exhausted from the engine.

The sensor element may be an oxygen sensor which detects an oxygen amount from the exhaust gas and may generate a voltage.

The method of an oxygen sensor heater control may further include detecting a temperature of the exhaust gas, and a predetermined temperature difference between a temperature of the exhaust gas and a temperature of the sensor element may be maintained.

When the temperature of the exhaust gas is lower than a predetermined value in an engine-stop state, power which is applied to the heater may be cut off.

An oxygen sensor heater control system according to an one form of the present disclosure may include: an engine which generates torque by combustion operation with injected fuel; a sensor unit which includes a sensor element which detects a characteristic of exhaust gas exhausted from the engine; and a control portion which controls the engine according to a characteristic signal which is detected at the sensor element, and the control portion may stop the engine such that the exhaust gas is not discharged and operate a heater that is positioned adjacent to the sensor element so as to heat the sensor element.

The control portion may control a heating temperature of the heater to be selectively increased or decreased according to a temperature difference between a temperature of the sensor element and a temperature of the exhaust gas.

When the temperature of the exhaust gas is lower than a determined value in an engine-stop state, the control portion may control power applied to the heater to be cut off.

In the engine-stop state, the control portion may control operation of the heater to heat inside of a protection tube so as to prevent external exhaust gas from flowing into the protection tube through a passage.

A temperature of the sensor element and a temperature of the exhaust gas may be detected by a temperature detecting sensor or selected from a map table which is predetermined according to a condition of the engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
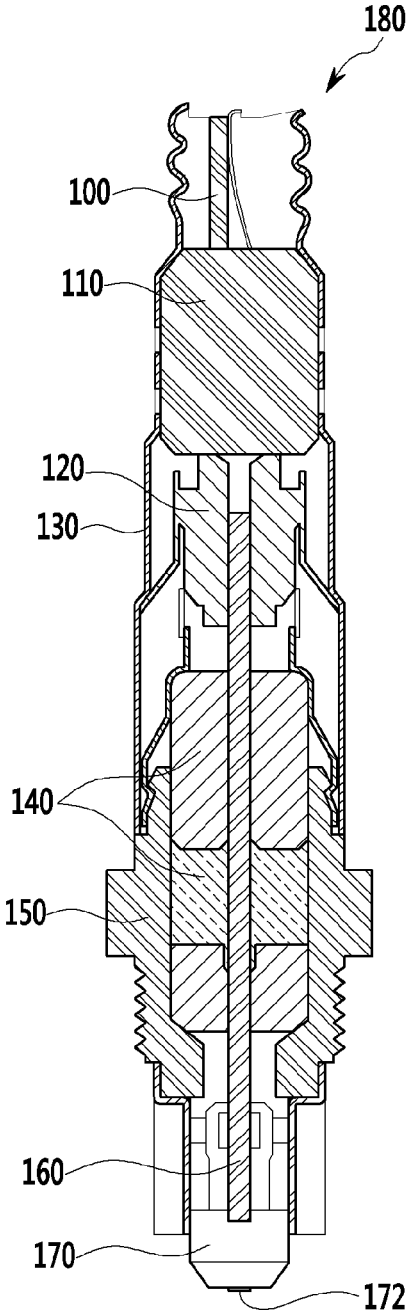
FIG. 1 is an overall cross-sectional view of a sensor unit according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application or uses. It should be understood that throughout the drawings, corresponding reference numerals indicate like or corresponding parts and features.

Figure 6:
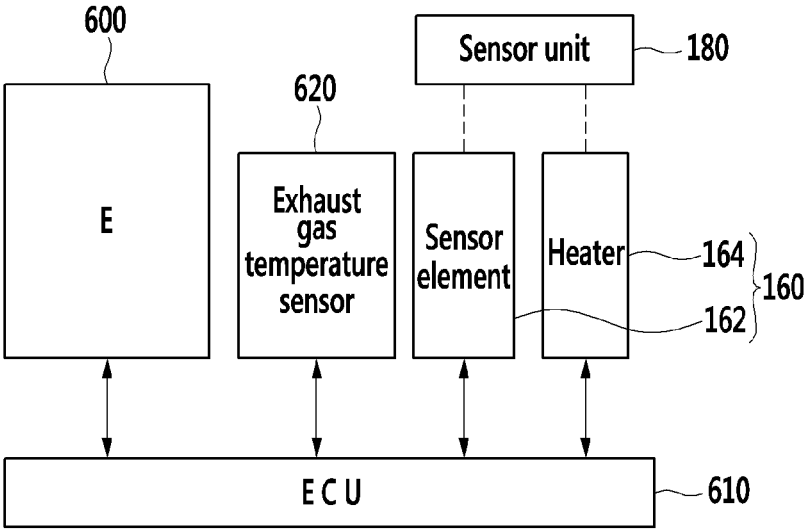
FIG. 6 is a schematic diagram of an oxygen sensor heater control system according to an exemplary form of the present disclosure.

FIG. 6 is a schematic diagram of an oxygen sensor heater control system according to embodiment form of the present disclosure.

Referring to FIG. 6, the oxygen sensor heater control system includes an engine 600, an exhaust gas temperature sensor 620, a sensor unit 180, a sensor element 162, a heater 164, and a control portion 610.

The engine 600 may combust a fuel in a cylinder thereof, and converts movement of a piston into torque. Combusted exhaust gas is exhausted through an exhaust manifold and an exhaust line.

The exhaust gas temperature sensor 620 may sense a temperature of the exhaust gas flowing in the exhaust line or the exhaust manifold, or a map table of a predetermined exhaust gas temperature may be applied instead of the exhaust gas temperature sensor 620. The predetermined exhaust gas temperature map table may include temperature information of exhaust gas according to an operation condition of the engine 600.

The sensor unit 180 includes the sensor element 162 and the heater 164. The sensor element 162 may generate a voltage through an oxygen concentration included in the exhaust gas, and the heater 164 may perform a function of heating the sensor element 162.

The control portion 610 is electrically connected to the exhaust gas temperature sensor 620 and the sensor element 162, and controls an operation of the heater 164. In addition, the sensor element 162 may generate the voltage by comparing the exhaust gas and an atmospheric oxygen concentration.

The control portion 610 may include one or more microprocessors operating with a predetermined program including instructions for a method for controlling an exemplary form of the present disclosure as described hereinafter.

FIG. 1 is an overall cross-sectional view of a sensor unit according to one aspect of the present disclosure.

Referring to FIG. 1, the sensor unit 180 includes a wire 100, a ring portion 110, a wire connection portion 120, an outer shell 130, a sealing portion 140, an engaging portion 150, a sensor element/heater 160, and a protection tube 170.

A space is formed in the protection tube 170, and the sensor element/heater 160 may be disposed at a center of the space. The engaging portion 150 may be fittings and be formed as a thread structure of which screw threads are formed at an exterior circumference thereof, and the engaging portion 150 may be screw-coupled to the exhaust manifold or the exhaust line.

The sealing portion 140 which forms a sealing structure may be interposed between an interior circumference of the engaging portion 150 and the sensor element/heater 160, and an upper end portion of the sensor element/heater 160 may be inserted into the wire connection portion 120.

The wire connection portion 120 is electrically connected to the wire 100 through the ring portion 110. The sensor element 162 and the heater 164 may be disposed on one body to be spaced apart from each other, and positions of the sensor element 162 and the heater 164 are well-known technology and therefore a detailed description thereof will be omitted.

Moreover, a passage 172 is formed in a center and a lower end portion of the protection tube 170, and the exhaust gas may flow in and be exhausted through the passage 172.

Figure 2:
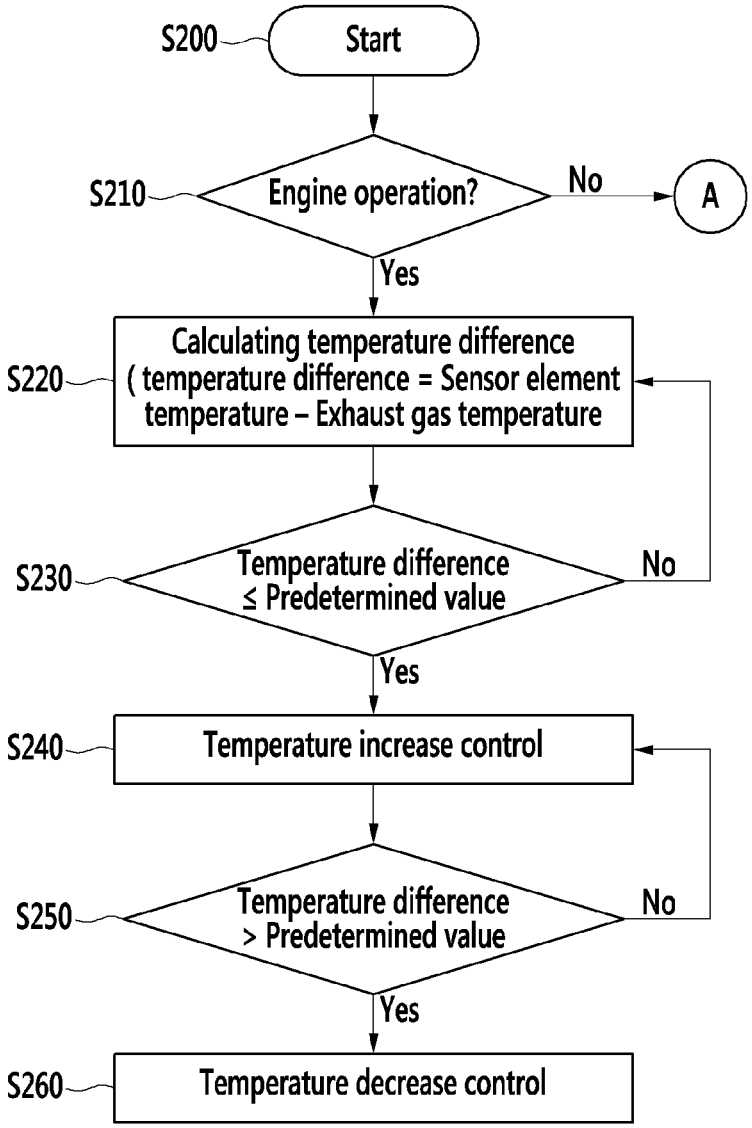
FIG. 2 is a flowchart of a method for controlling a sensor unit which is provided at an oxygen sensor heater control system according to an exemplary form of the present disclosure.

FIG. 2 is a flowchart of a method for controlling a sensor unit which is provided at an oxygen sensor heater control system according to one form of the present disclosure.

Referring to FIG. 2, controlling the heater 164 starts in step S200, and in step S210, it is determined if the engine 600 is operated. Whether the engine 600 is operated or not may be detected by a rotation speed of the engine 600, a fuel injection amount, and on the like.

When it is determined that the engine 600 is operated, the control portion 610 calculates a temperature difference in step S220. The exhaust gas temperature subtracted from the sensor element 162 temperature is the temperature difference. Further, when it is determined that the temperature difference is a predetermined value or less in step S230, the control portion 610 turns on or increases power which is supplied to the heater 164 in order to increase the temperature in the protection tube 170 and the sensor element 162 in step S240.

Thereafter, when it is determined that the temperature difference is greater than the predetermined value in step S250, then the control portion 610 turns off or decreases power which is applied to the heater 164 such that the temperature in the protection tube 170 and the temperature of the sensor element 162 are decreased in step S260.

Figure 3:
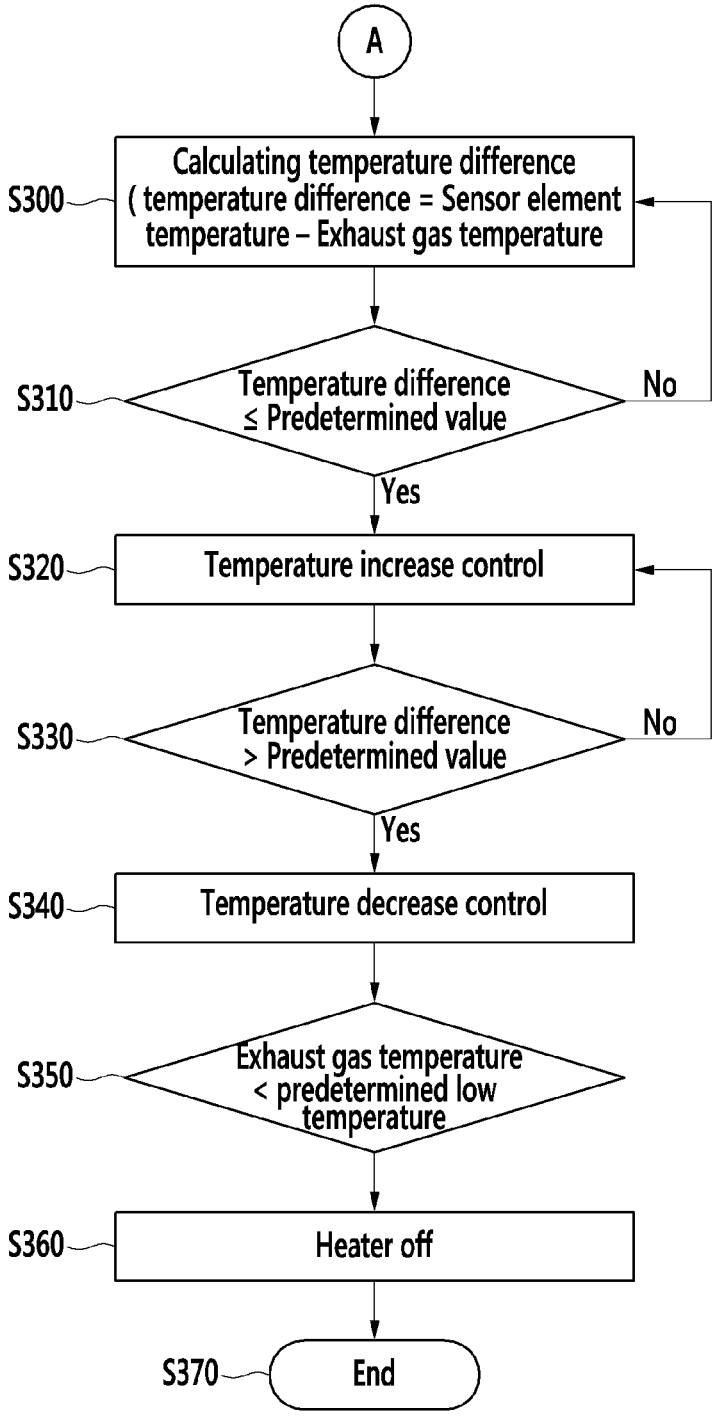
FIG. 3 is a flowchart of a method for controlling a sensor unit which is provided at an oxygen sensor heater control system according to an exemplary form of the present disclosure.

After step S210, when it is determined that the engine 600 is turned off, step S300 is performed as described in FIG. 3.

FIG. 3 is a flowchart of a method for controlling a sensor unit which is provided at an oxygen sensor heater control system according to a form of the present disclosure.

Referring to FIG. 3, when the engine 600 is turned off, the control portion 610 calculates a temperature difference between the sensor element 162 and the exhaust gas in step S300. The exhaust gas temperature subtracted from the sensor element 162 temperature is the temperature difference.

According to one form of the present disclosure, temperature of the exhaust gas is detected by the exhaust gas temperature sensor 620 or it may be selected from a predetermined map table.

Moreover, the temperature of the sensor element 162 is also detected by an additional temperature detecting sensor or it may be selected from a predetermined map table.

In step S310, when it is determined that the temperature difference is a predetermined value or less, the control portion 610 turns on or increases power which is supplied to the heater 164 in step S320, and when it is determined that the temperature difference is greater than the predetermined value in step S330, then the control portion 610 turns off or decreases power which is applied to the heater 164 in step S340.

In step S350, when it is determined that the exhaust gas temperature is lower than a predetermined low temperature, the control portion 610 determines that the heater 164 is sufficiently operated. Thus, the heater 164 is completely turned off in step S360, finishing the control of the heater 164 in step S370.

Figure 4:
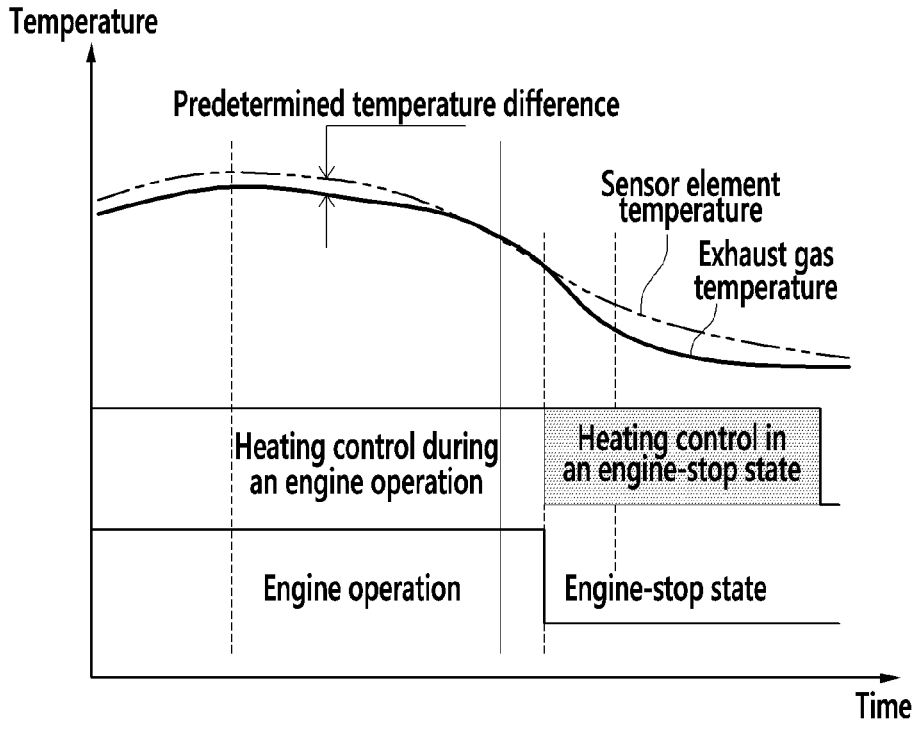
FIG. 4 is a graph showing a temperature change of an oxygen sensor heater control system according to an exemplary form of the present disclosure.

FIG. 4 is a graph showing a temperature change of an oxygen sensor heater control system according to a form of the present disclosure.

Referring to FIG. 4, a horizontal axis indicates a time and a vertical axis indicates a temperature of an exhaust gas and a temperature of the sensor element 162.

During operation of the engine 600, active operative control is performed in order to control the heater 164, and during non-operation of the engine 600, inoperative heating control is performed in order to control the heater 164.

As shown, during operation of the engine 600, the power supplied to the heater is controlled, and thereby the temperature of the sensor element 162 (or the temperature in the protection tube 170) is controlled to be greater than the exhaust gas temperature.

Further, during non-operation of the engine 600, the power supplied to the heater 164 is controlled, and thereby the temperature of the sensor element 162 (or the temperature in the protection tube 170) is controlled to be greater than the exhaust gas temperature.

As discussed above, in a state in which the engine 600 is on or off, the temperature of the sensor element 162 (or the temperature in the protection tube 170) is at least controlled to be greater than that of the exhaust gas.

Figure 5:
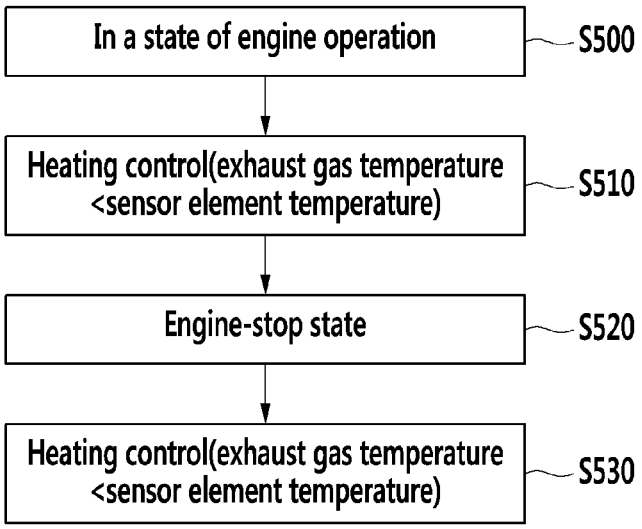
FIG. 5 is a schematic flowchart of a method for controlling a temperature of an exhaust gas and sensor element according to an exemplary form of the present disclosure.

FIG. 5 is a schematic flowchart of a method for controlling temperature of an exhaust gas and sensor element according to a form of the present disclosure.

Referring to FIG. 5, when the engine 600 is operated in step S500, the heater 164 is controlled such that the temperature of the sensor element 162 (or the temperature in the protection tube 170) is greater than the temperature of the exhaust gas in step S510.

In step S520, when the engine 600 is turned off, the heater 164 is controlled such that the temperature of the sensor element 162 (or the temperature in the protection tube 170) is greater than the temperature of the exhaust gas (or the exhaust line or an inside of the exhaust manifold) in step S530. Thereafter, when a predetermined time has elapsed or the temperature of the exhaust gas is lower than the predetermined low temperature, the heater 164 is turned off and the control of the heater 164 is finished.

The description of the disclosure is merely exemplary in nature and, thus, variations that do not depart from the substance of the disclosure are intended to be within the scope of the disclosure. Such variations are not to be regarded as a departure from the spirit and scope of the disclosure.

DESCRIPTION OF SYMBOLS

100: wire 110: ring portion
120: wire connection portion 130: outer shell
140: sealing portion 150: engaging portion
160: sensor element/heater 162: sensor element
164: heater 170: protection tube
172: passage 600: engine
610: control portion 620: temperature sensor
180: sensor unit

What is claimed is:

1. An oxygen sensor heater control system comprising:
an engine which generates torque by a combustion operation with injected fuel; a sensor unit which includes a sensor element which detects a characteristic of exhaust gas exhausted from the engine; and
a control portion which controls the engine,
wherein the control portion stops the engine and operates a heater that is positioned adjacent to the sensor element so as to heat the sensor element,
when the temperature of the exhaust gas is lower than a determined value in an engine-stop state, the control portion controls power applied to the heater to be cut off, and
in the engine-stop state, the control portion controls operation of the heater to heat inside of a protection tube so as to prevent external exhaust gas from flowing into the protection tube through a passage;
wherein the control portion controls a heating temperature of the heater to be selectively varied according to a temperature difference between a temperature of the sensor element and a temperature of the exhaust gas.

2. The oxygen sensor heater control system of claim 1, wherein a temperature of the sensor element and a temperature of the exhaust gas are detected by a temperature detecting sensor.

3. The oxygen sensor heater control system of claim 1, wherein a temperature of the sensor element and a temperature of the exhaust gas are selected from a map table which is predetermined according to a condition of the engine.

4. An oxygen sensor heater control system comprising:
an engine which generates torque by a combustion operation with injected fuel;
a sensor unit which includes a sensor element which detects a characteristic of exhaust gas exhausted from the engine; and
a control portion which controls the engine according to a characteristic signal which is detected at the sensor element,
wherein the control portion stops the engine such that the exhaust gas is not discharged and operates a heater that is positioned adjacent to the sensor element so as to heat the sensor element,
the control portion controls a heating temperature of the heater to be selectively varied according to a temperature difference between a temperature of the sensor element and a temperature of the exhaust gas, and in the engine-stop state, the control portion controls operation of the heater to heat inside of a protection tube so as to prevent external exhaust gas from flowing into the protection tube through a passage.

* * * * *